United States Patent [19]

Mulligan

[11] Patent Number: 4,697,298

[45] Date of Patent: Oct. 6, 1987

[54] TRAVELING CLEANER SYSTEM

[75] Inventor: William L. Mulligan, Charlotte, N.C.

[73] Assignee: Parks-Cramer Company, Fitchburg, Mass.

[21] Appl. No.: 913,510

[22] Filed: Sep. 30, 1986

[51] Int. Cl.[4] ..... A47L 5/38

[52] U.S. Cl. ..... 15/312 R; 15/316 R; 15/319

[58] Field of Search ..... 15/312 R, 312 A, 319, 15/316 R

[56] References Cited

U.S. PATENT DOCUMENTS

| | | | |
|---|---|---|---|
| 2,613,611 | 10/1952 | Simon | 104/150 |
| 2,823,409 | 2/1958 | Allred | 15/312 R |
| 3,051,978 | 9/1962 | Auffrey | 15/312 A |
| 3,112,601 | 12/1963 | McCullough | 57/52 |
| 3,163,879 | 1/1965 | Lamb | 15/319 X |
| 3,299,463 | 1/1967 | McEachern | 15/312 |
| 3,305,184 | 2/1967 | Seress et al. | 15/312 A X |
| 3,376,596 | 4/1968 | Duncan | 15/312 |
| 3,440,097 | 4/1969 | Gleaton | 134/37 |
| 3,486,319 | 12/1969 | Lee, Jr. et al. | 57/34 |
| 3,714,676 | 2/1973 | Sloan | 15/312 R |

*Primary Examiner*—Chris K. Moore

*Attorney, Agent, or Firm*—Bell, Seltzer, Park & Gibson

[57] ABSTRACT

A traveling cleaner system with means for effecting a temporary alteration in the rate of travel of the traveling cleaner unit which is characterized by its ability to provide additional amounts of cleaning to preselected portions of the textile mill. The invention is comprised of a traveling cleaner unit that is movable along an overhead track that extends above textile machinery or that is mounted to a crane bridge that travels reciprocally along rails extending parallel to rows of textile machinery. The traveling cleaner unit includes blowers for direction a reciprocating cleaning current of air onto the underlying machinery. In one enbodiment a variable speed drive motor propels the cleaner unit along the overhead track and in the second embodiment, a variable speed drive motor propels the crane bridge along the rails. In addition to the traveling cleaner unit, the traveling cleaner system includes actuators, a switch that is mounted on the traveling cleaner unit and is engaged by the actuators and control means consisting primarily of a timer and speed varying means. The traveling cleaner unit alters its rate of travel when it passes preselected portions of the textile mill with the result that the textile mill is more thoroughly cleaned.

15 Claims, 9 Drawing Figures

TRAVELING CLEANER SYSTEM

BACKGROUND OF THE INVENTION

This invention relates to the cleaning of textile mills and more particularly to an improved traveling cleaner system for textile mills.

Traveling cleaner systems such as those disclosed in U.S. Pat. Nos. 3,304,570 and 3,422,481 assigned to Parks-Cramer Company have been widely used in textile mills for removing lint and other fibrous waste from textile machinery and from the areas of the textile mill surrounding such textile machinery. As disclosed in those patents, such cleaner systems typically consist of a cleaner unit with a housing containing one or more blowers that provide an air blast which dislodges the lint from the textile machinery so that it might be collected by a suction. The cleaner unit travels above the floor of the textile mill at a uniform speed. In some cleaner systems, the cleaner unit is mounted on a crane bridge that travels reciprocally on rails over rows of textile machinery, while in other systems, the cleaner unit is mounted for travel along an overhead track or monorail that extends over the floor of the textile mill.

In some instances, certain areas of a textile mill may require more thorough cleaning than other portions of the same textile mill. For example, the weaving of certain types or styles of fabric may generate such a high level of lint and/or fibrous waste at particular portions of a loom that the lint or fibrous waste accumulates on the loom despite the periodic cleaning provided by the traveling cleaner system. U.S. Pat. No. 3,525,117 to Gleaton suggests that more thorough cleaning may be achieved by varying the volume and velocity of air discharged onto different portions of the textile machinery. However, this approach is not practical for some applications, especially where there are sensitive components on the textile machinery which would be adversely effected by higher air volumes or velocities.

SUMMARY OF THE INVENTION

It is an object of the present invention to overcome the limitations pointed out above in connection with the known embodiments of traveling cleaner systems and to provide an improved traveling cleaner system which provides better cleaning of a textile mill than those presently available. More particularly, it is an object of this invention to provide a traveling cleaner system in which the traveling cleaner unit varies its speed at certain preselected points along its path of travel and for certain predetermined lengths of time in order to provide increased amounts of cleaning to particular portions of the textile mill. The speed of the traveling cleaner unit can be increased or decreased at any location along its path of travel and the location is easily adjusted so that the traveling cleaner system can be adapted for optimal use with various types of textile machinery. The length of time that the traveling cleaner unit travels at a particular speed can be selected so as to provide additional cleaning only to those portions of the textile machinery requiring it. Additionally, the present invention can be adjusted so that the traveling cleaner unit increases its speed when traveling over machinery that is idle, thereby further increasing the efficiency of the traveling cleaner system and the textile mill as a whole.

The apparatus of the present invention in its preferred embodiment is comprised of a traveling cleaner unit which is movable above the textile machinery and which includes a blower for directing a reciprocating cleaning current of air onto the underlying textile machinery. The traveling cleaner unit is supported above the underlying textile machinery by a crane bridge that extends transversely over a plurality of rows of textile machinery or by an overhead track that extends over individual rows of textile machinery. In those instances where the traveling cleaner unit is supported by a crane bridge, the traveling cleaner unit is mounted to the crane bridge and travels with the crane bridge over the underlying rows of textile machinery. In those instances where the cleaner unit is supported by an overhead track, the traveling cleaner unit travels independently along the track over the underlying machinery. The traveling cleaner system additionally includes means by which the speed of the traveling cleaner unit can be altered for predetermined lengths of time at preselected points along its path of travel in order to provide better cleaning of the textile mill. In those embodiments where the traveling cleaner unit is supported by a crane bridge, the speed of travel of the crane bridge is reduced, thereby reducing the speed of travel of the cleaner unit, and in those embodiments where the traveling cleaner unit travels independently along an overhead track, the speed of the traveling cleaner unit itself is reduced. In either embodiment, the speed of travel of the cleaner unit is controlled by the cooperation of actuators, a sensor that is engaged by the actuators and a timer that is engaged by the sensor and that itself engages a speed varying means.

Other advantages and a fuller understanding of the invention will be had from the following detailed description when taken in conjunction with the accompanying drawings.

DESCRIPTION OF THE ILLUSTRATED EMBODIMENT

The detailed description which follows and the accompanying drawings describe how the traveling cleaner system of the present invention may be used for cleaning a series of looms in a weaving mill. It will be understood, however, that the present invention may be used for cleaning various other types of textile machinery, and may use other specific configurations of traveling cleaner units besides those specifically illustrated and described herein.

Figure 3:
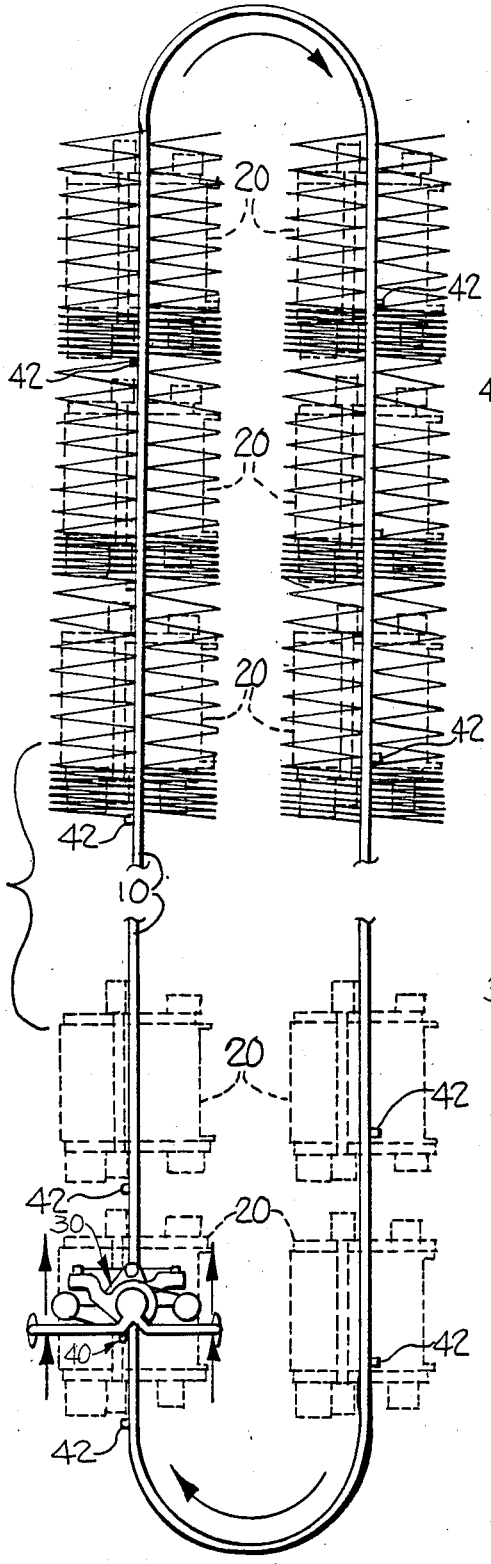
FIG. 3 is a partial plan view of a textile mill showing a traveling cleaner system in which the traveling cleaner unit travels independently on an overhead track in a continuous path in one direction and showing the more concentrated pattern of the cleaning currents directed onto portions of the textile mill when the traveling cleaner unit decreases it speed of travel for a predetermined length of time.
Figure 4:
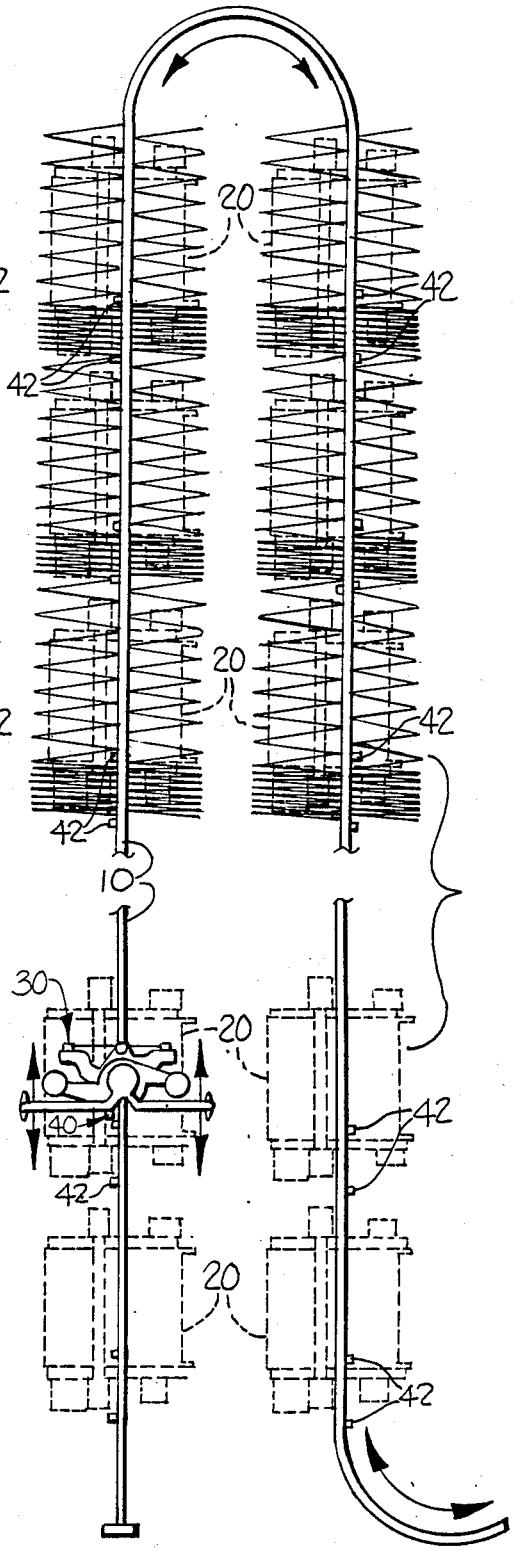
FIG. 4 is a plan view of a textile mill similar to FIG. 3 in which the traveling cleaner unit travels independently on an overhead track in both directions and reverses its direction of travel when it reaches the termination of the overhead track.

The following description encompasses two embodiments of traveling cleaner systems: those systems in which the traveling cleaner unit is mounted to a crane bridge that travels on rails that extend parallel to rows of underlying textile machinery and those cleaning systems in which the traveling cleaner unit travels independently along an overhead track that extends over rows of textile machinery. In those embodiments, shown in FIG. 1, where the cleaner unit travels independently along an overhead track, depending upon the configuration of the overhead track, the cleaner unit may travel along a continuous path over the textile machinery as shown in FIG. 3 or it may reverse its direction and travel in the opposite direction when it reaches the termination of the overhead track as shown in FIG. 4. The speed of travel of the traveling cleaner unit is altered for a predetermined length of time and at predetermined points along its path of travel so as to provide additional cleaning to certain portions of the textile mill.

Figure 1:
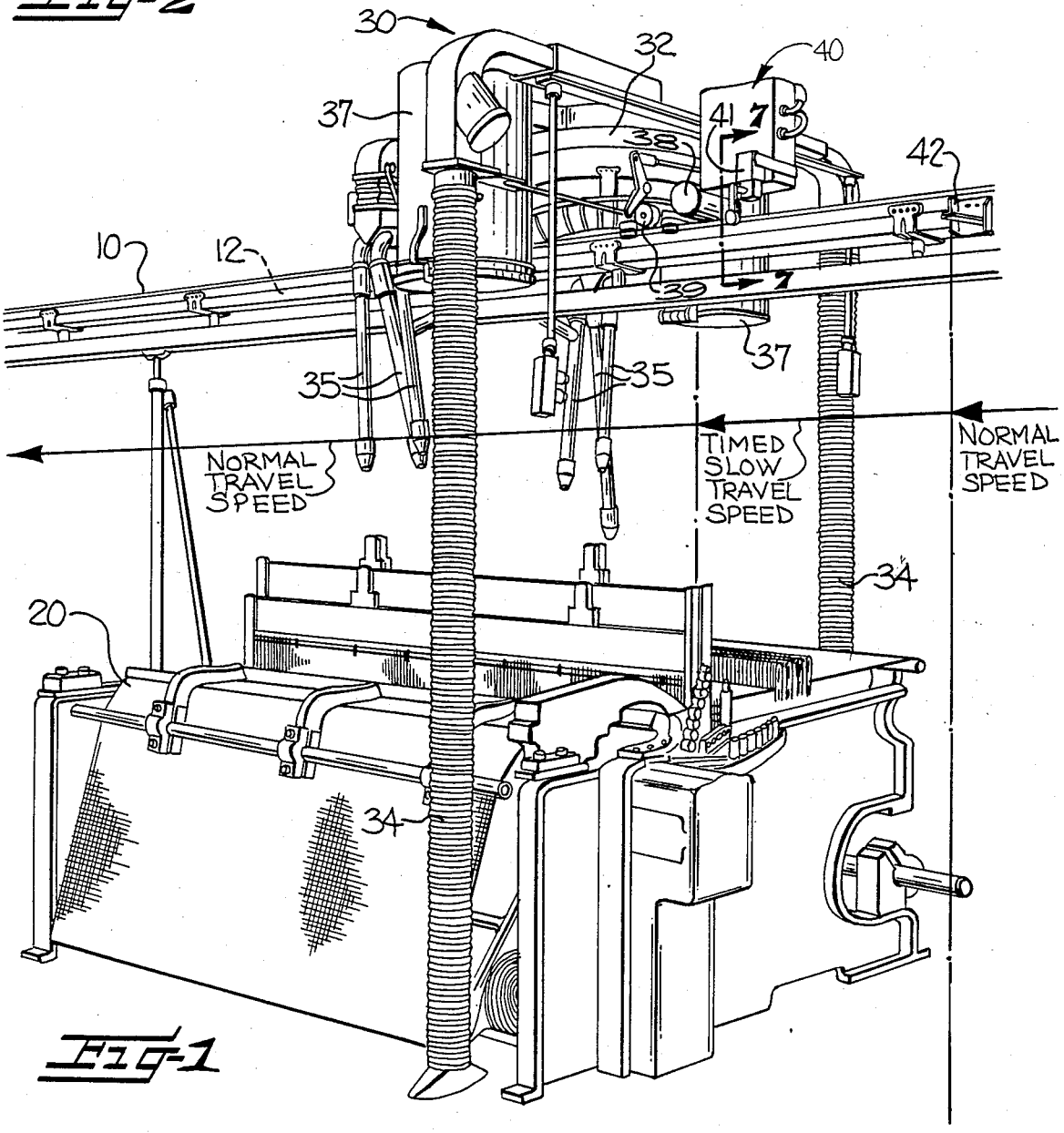
FIG. 1 is a perspective view of a textile mill showing a traveling cleaner system in accordance with the present invention wherein the traveling cleaner unit travels independently on an overhead track above rows of textile machinery.

As seen in FIG. 1, the traveling cleaner system includes an overhead track 10 or monorail that extends along a predetermined path through the mill and past a series of looms, one of which is generally indicated by the reference character 20, and past various other apparatus associated with the looms. The overhead track carries a plurality of conductors 12 that extend the entire length of the overhead track and provide a source of electrical power to the traveling cleaner unit 30 which moves along the overhead track.

The path of travel that the overhead track 10 follows may vary as dictated by the particular mill design. As shown in FIG. 3, the track may define a continuous or endless circuit, and in such cases the traveling cleaner unit ordinarily travels in the same direction relative to the machinery along the overhead track. Or, as shown in FIG. 4, the overhead track 10 may terminate when it reaches the end of a row of looms, and in those embodiments the traveling cleaner unit is designed to reverse its direction of travel when it reaches the termination of the overhead track. In such cases, the traveling cleaner unit passes the textile machinery in both directions.

The traveling cleaner unit is generally indicated in FIGS. 1, 3 and 4 by the reference character 30 and comprises a housing 32 which contains one or more fans providing a source of pressurized air for the cleaning of lint and other waste from the textile machinery and a source of suction for collecting the lint and waste dislodged from the machinery. As shown in FIG. 1, the illustrated traveling cleaner unit shows the use of nozzles 35 that direct a current of air downwardly onto underlying portions of the loom 20 and flexible suction air sleeves 34 extending from the housing 32 to the floor of the textile mill for collecting lint and waste from the floor of the mill. The nozzles 35 reciprocate in a direction generally perpendicular to the direction of travel of the traveling cleaner unit and transversely to the underlying rows of textile machinery. This reciprocation in conjunction with the movement of the traveling cleaner unit directs an oscillating cleaning current onto the underlying textile machinery as shown in FIGS. 3 and 4. The cleaner unit 30 is also provided with canisters 37 that accumulate and store the lint and waste collected by the suction sleeves 34.

In the embodiment illustrated in FIG. 1, movement of the cleaner unit is effected by a drive means in the form of an electric drive motor 38 and cooperating drive wheels 39 which engage the overhead track 10.

From time to time in its course of travel, the traveling cleaner unit 30 may pass over areas of the textile mill which are especially prone to the generation of lint, or which for other reasons are particularly difficult to clean. One example of a difficult area to clean is the area of a textile mill containing the portions of weaving looms in which the filling yarn is first inserted into the cloth (the filling end). At the filling end of the loom, a considerable amount of lint and other waste is generated and the operations that occur there are particularly sensitive to excess lint; it is thus especially important that such lint be removed before it accumulates. In other instances, there may be areas of the textile mill which do not demand the level of cleaning normally provided by the traveling cleaner unit, such as for example, areas unoccupied by textile machinery or areas that contain idle machinery. The present invention makes it possible to respond to the unique cleaning needs in selected areas of the mill by providing means for temporarily altering the rate of travel of the traveling cleaner unit as it passes preselected areas of the mill so as to achieve more efficient and effective cleaning. More particularly, the alteration in the rate of travel of the traveling cleaner unit, among other things alters the concentration or density (i.e. the number of oscillations per length) of the cleaning air currents created by the reciprocation of the nozzles 35 and the movement of the cleaner unit.

Figure 5:
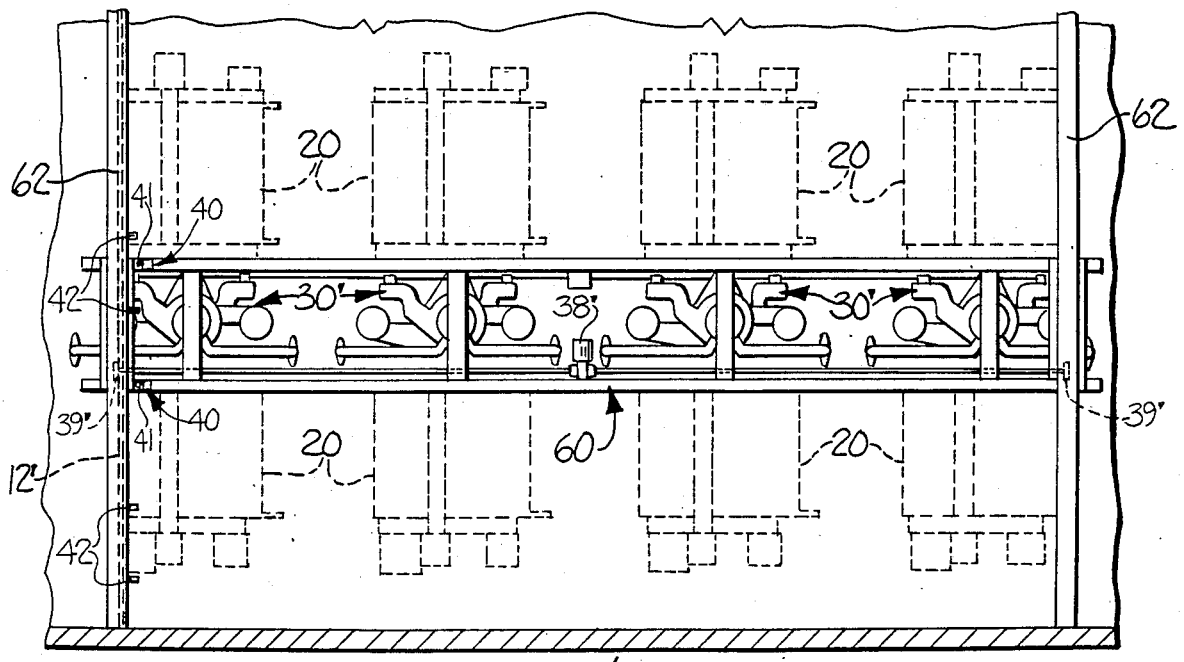
FIG. 5 is a partial plan view of a textile mill showing a traveling cleaner system in which the traveling cleaner unit is mounted on a crane bridge that travels reciprocally on rails over underlying rows of textile machinery.

As shown in FIGS. 3, 4 and 5, when the traveling cleaner unit's rate of travel decreases, the number of oscillations of the nozzles 35 per unit length increases and thereby provides more concentrated cleaning to the portions of machinery underlying the unit. During normal speed operation, the oscillating nozzles trace a generally sinusoidal or zig-zag sweeping path of tavel over the machinery, as illustrated. While all portions of the machinery along the path of travel will not be swept by the nozzles in a single pass, successive passes of the cleaner ultimately sweep all portions of the machine and adequately control the accumulation of lint for most conditions. However, when the rate of travel of the traveling cleaner unit is reduced sufficiently in difficult to clean areas, the density of the nozzle oscillations will be such that the cleaning currents overlap, thereby further increasing the effective cleaning directed onto the textile machinery.

The temporary alteration in the rate of travel of the traveling cleaner unit is accomplished by employing a suitable variable speed motor as the drive motor and providing a control means associated with the variable speed motor for temporarily altering the motor speed for a predetermined period of time in response to the traveling cleaner unit passing selected areas of the textile mill.

By way of example, as shown in FIG. 1, the zone directly overlying the filling end of loom 20 may require an increased level of cleaning in order to keep the area free of lint and fly. An actuator 42 is mounted to the overhead track at a point corresponding to where the traveling cleaner unit begins its path of travel over the filling end. The actuator may be bolted, clamped or otherwise suitably secured to the overhead track 10. A corresponding sensor 41 in the form of a switch is carried by the control unit 40 and is positioned for being engaged by the actuator during movement of the traveling cleaner along the track, as shown more fully in FIG. 7. As discussed more fully below, the engagement of the switch 41 initiates a temporary alteration (in this instance reduction) in the speed of operation of the drive motor. The alteration in the speed of the drive motor causes the traveling cleaner unit to slow down and causes an increase in the number of oscillations of the nozzles 35 per unit length and a corresponding increase in the cleaning currents directed onto the underlying machinery. After the drive motor has operated at a reduced speed for a predetermined period of time sufficient to traverse the filling end of the loom (the distance marked "Timed Slow Travel Speed" in FIG. 1), the drive motor resumes its normal speed of operation.

Figure 7:
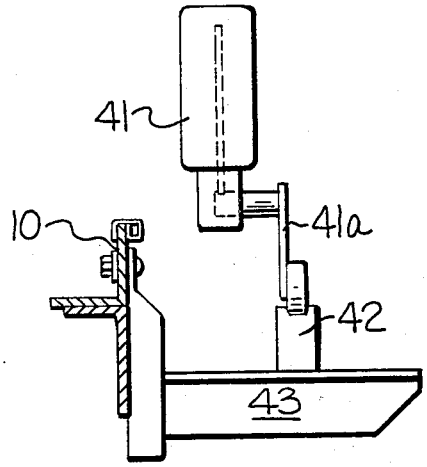
FIG. 7 is a fragmentary cross-sectional view taken substantially along line 7—7 of FIG. 1, showing the sensor as it is engaged by the actuator.

In installations like that shown in FIG. 3 where the overhead track forms an endless circuit and the traveling cleaner unit always travels in the same direction, a simple stationary actuator similar to that shown in FIG. 7 may be suitably employed. However, in those embodiments like that shown in FIG. 4 where the overhead rail terminates and the traveling cleaner unit reverses direction, a different arrangement is needed in order to ensure that the change in speed will occur over the same portion of the textile machinery regardless of the direction of travel of the cleaner unit. More particularly, a pair of actuators should be positioned at each end of the zone of the textile machinery requiring additional cleaning with each actuator engaging the sensor only when the traveling cleaner unit is moving into the zone.

Figure 8:
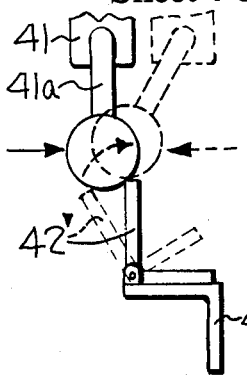
FIG. 8 is a schematic elevation showing an embodiment of the actuator in which the sensor is engaged when the traveling cleaner unit moves in one direction, but not even it moves in the other direction.

FIG. 8 illustrates one suitable construction of an actuator for accomplishing this function. As illustrated, the actuator comprises a generally L-shaped member 42' which is mounted for pivotal movement to a base 43'. When the traveling cleaner unit and its associated actuator arm **41*a* are moving to the right, in the direction indicated by the solid arrow, the upstanding actuator engages the actuator arm of the switch and engages the switch. However, when the unit is moving in the opposite direction, as indicated by the broken arrow, the L-shaped member 42'** pivots and swings out of the way, as indicated in the dashed lines, without engaging the switch. It will be understood by those skilled in the art that in these instances a stationary actuator and an appropriate set of contacts can be utilized to achieve the same results.

Figure 2:
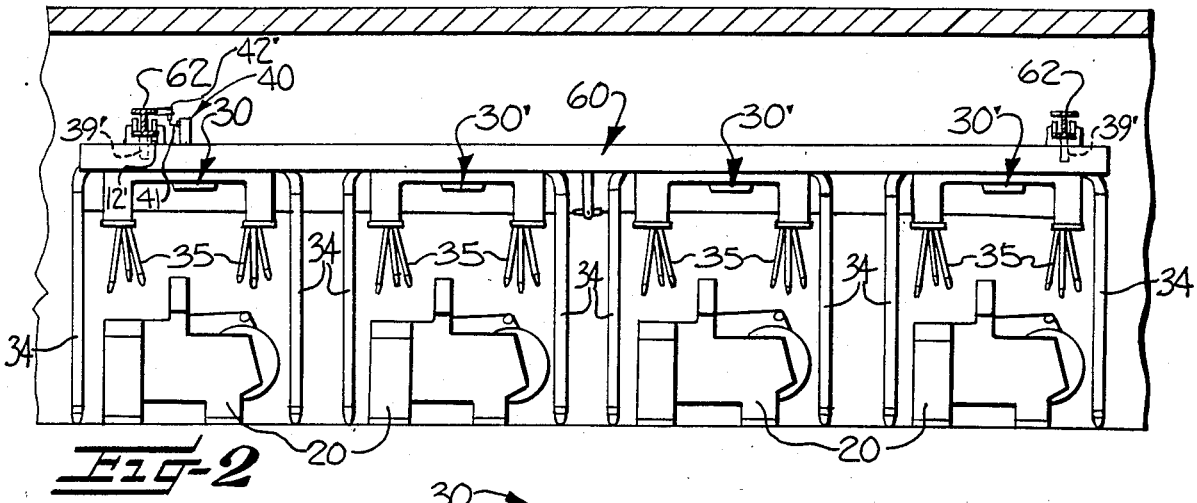
FIG. 2 is a side elevational view of a textile mill showing a traveling cleaner system disposed above rows of textile machinery in which the traveling cleaner unit is mounted on a crane bridge that travels reciprocally on rails over rows of textile machinery.
Figure 6:
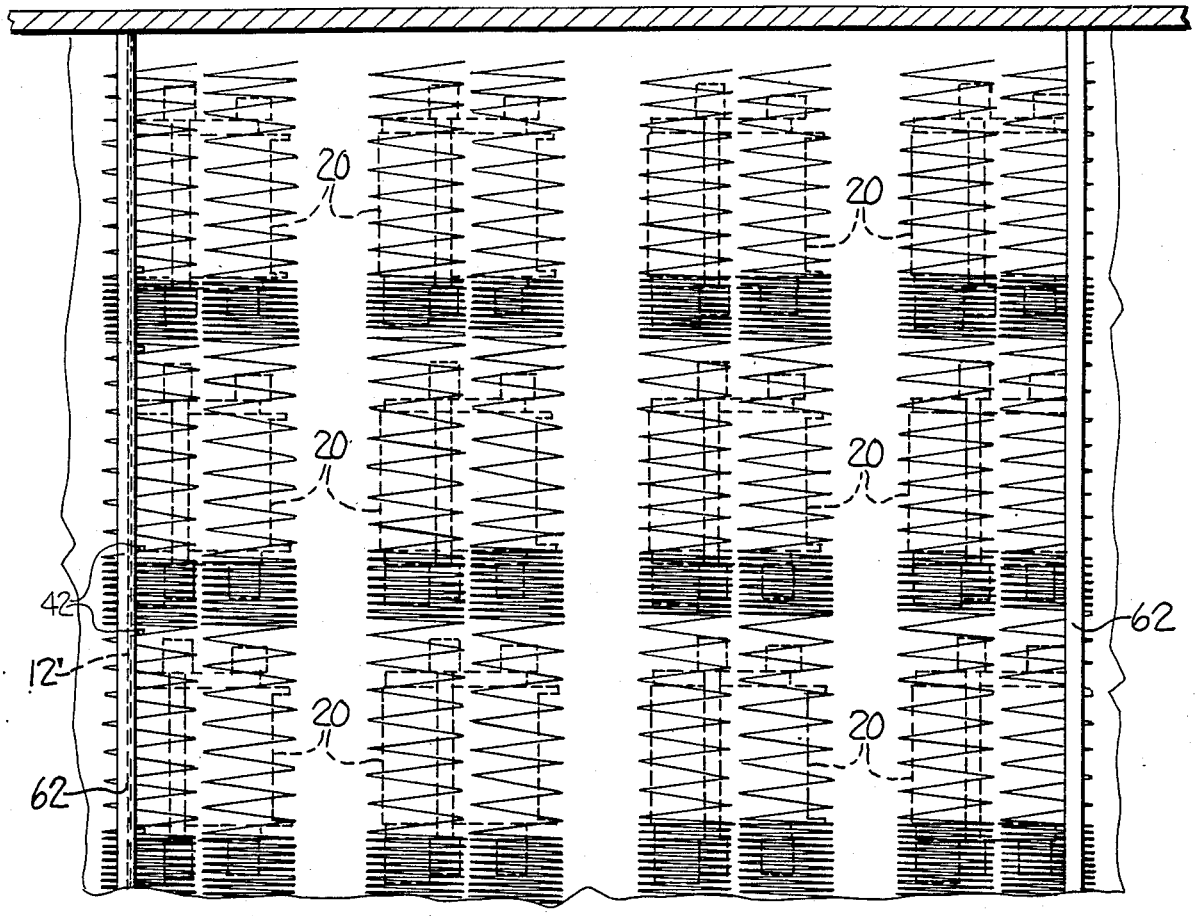
FIG. 6 is a plan view similar to FIG. 5 showing the more concentrated pattern of the cleaning currents directed onto preselected portions of the textile mill when the crane bridge on which the traveling cleaner unit is mounted decreases its speed of travel for a predetermined length of time.

As shown in FIGS. 2, 5 and 6, in those embodiments where the cleaner unit is mounted on an overhead crane bridge, the traveling cleaner unit 30' is mounted to the crane bridge 60 which travels along the rail 62 that extends parallelly over rows of looms 20 or other textile machinery. The traveling cleaner unit 30' being substantially the same as the traveling cleaner unit 30 utilized in the embodiment described above. The rail carries a plurality of conductors 12' extending the entire length of the rails that provide a source of electrical power to an electric drive motor 38' which propels the crane bridge along the rails. The crane bridge carries drive wheels 39' that cooperate with the drive motor 38' and engage the overhead rails. As is illustrated in FIGS. 2, 5 and 6 a plurality of traveling cleaner units 30' is typically mounted to the crane bridge so that a single pass by the crane bridge over the rows of underlying textile machinery will provide cleaning to all of the textile machinery.

In those embodiments illustrated in FIGS. 2, 5 and 6 where the traveling cleaner unit is mounted to a crane bridge, the interaction of the actuator 42, sensor 41, and control unit 40 is essentially the same as in the embodiment where the traveling cleaner unit travels along the overhead track independently. The actuator is mounted on the overhead rail at a point where the altered speed of travel of the traveling cleaner units is desired. The sensor 41 is carried by the control unit 40 which is positioned on the crane bridge that carries the traveling cleaner units. When the crane bridge travels past the actuator, the switch is engaged and initiates a temporary alteration in the speed of operation of the drive motor which cause an alteration in the speed of travel of the crane bridge and traveling cleaner units. As shown in FIG. 6, a reduction in the speed of travel of the crane bridge over difficult to clean areas, results in an increase in the density of the nozzle oscillations which result in cleaning current overlap and thereby increase the effective cleaning directed onto the underlying textile machinery. After the drive motor is operated at a reduced speed for a predetermined period of time sufficient to traverse the filling ends of the looms, the drive motor resumes its normal speed of operation.

Inasmuch as in traveling cleaner systems of this type, the crane bridge reverses its directions of travel when it reaches the end of the rail, an actuator of the type illustrated in FIG. 8 and whose operation is more fully explained above should be utilized.

Figure 9:
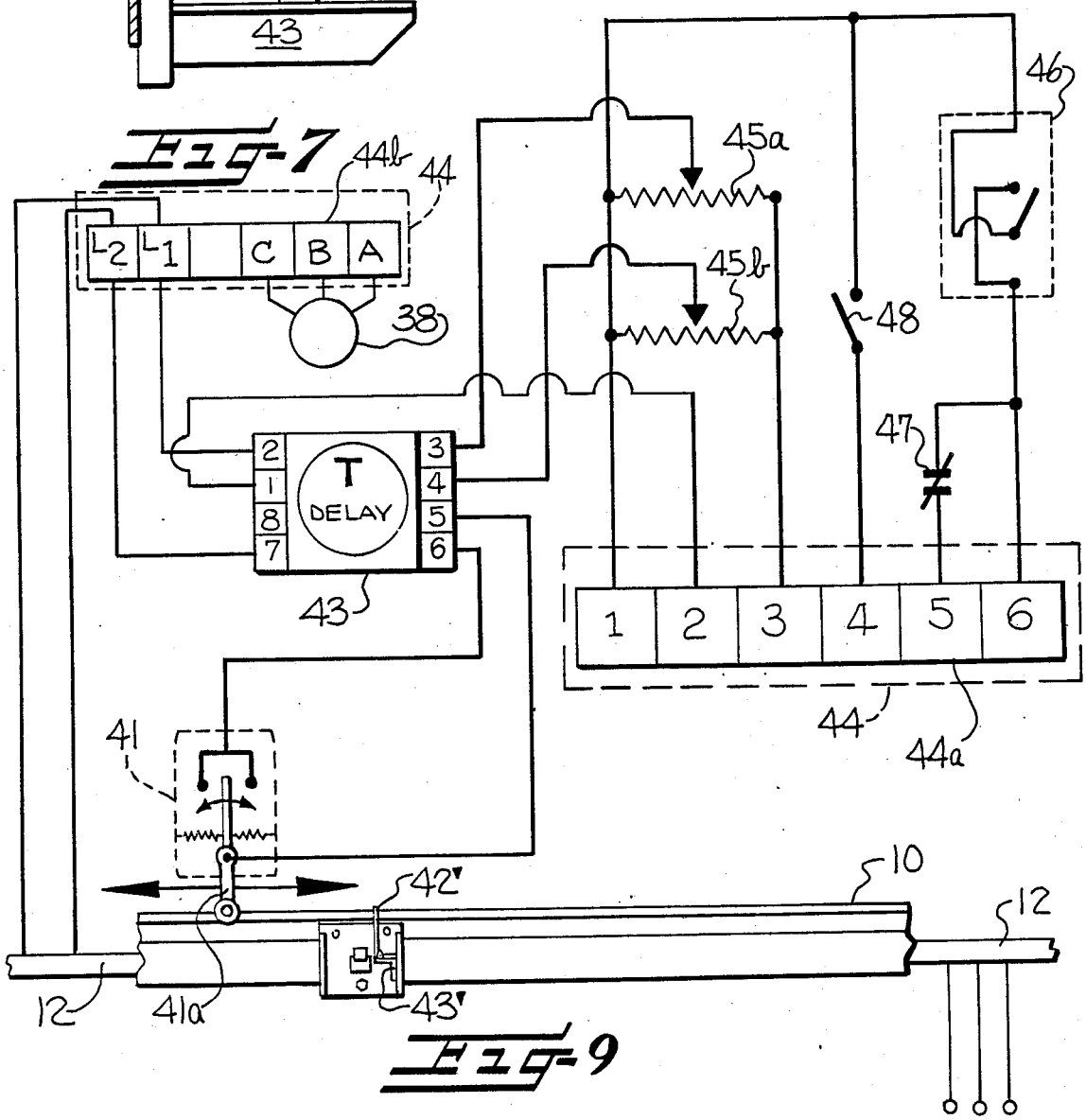
FIG. 9 is a schematic diagram of the means for temporarily altering the rate of travel of the traveling cleaner unit.

FIG. 9 shows the interconnection of the different components of the means for temporarily altering the rate of travel of the traveling cleaner unit 30(30'). The interconnection and function of the different components is the same for either of the embodiments of the traveling cleaner systems described. As enumerated above, the actuation of the switch 41 begins the events that lead to the temporary alteration in the speed of the traveling cleaner unit(s). In the embodiment illustrated in FIG. 9, the switch 41 has an arm **41*a* which is pivotally moved when the traveling cleaner unit or crane bridge passes by the actuator 42** in either direction.

The means for temporarily altering the rate of travel of the traveling cleaner unit includes a timer 43. The timer is connected to the switch 41 in such a way that whenever the switch 41 is engaged the timer 43 is, in turn, engaged. The timer is furthermore connected to a speed varying means in such a way that when the timer is engaged by the switch, the speed varying means is engaged for the predetermined length of time set on the timer. A timer manufactured by SSAC, Inc. and having part number TRB230H2X120 2078 or the equivalent is illustrated in FIG. 9, but any timer capable of producing the desired time delay may be utilized. The timer allows a great deal of flexibility in the use of the apparatus in that cleaning currents can be concentrated on specific portions of a textile mill for any predetermined length of time.

The speed varying means consists of any device that is capable of receiving an input signal from the timer 43 and, in response, producing an output that varies the motor speed of the variable speed motor 38 or 38'. The specific embodiment of the speed varying means will depend upon the particular type of variable speed motor employed, as is well understood by those skilled in the art. In the illustrated embodiment the speed varying means consists of a frequency inverter 44 that is illustrated schematically by the two dashed line boxes in FIG. 9. One terminal strip 44*a* of the frequency inverter is indirectly connected to one pole of the timer. The variable resistors 45*a* and 45*b* are located in this interconnection and form a control link for engaging the frequency inverter 44. The other terminal strip 44*b* of the frequency inverter is directly connected to the conductors 12 and variable speed motor 38. A frequency inverter manufactured by Century and being their E Plus AC Adjustable Speed Control or the equivalent is utilized in the present embodiment, but any frequency inverter adaptable for use with the variable speed drive motor 38 may be utilized.

As noted above, interconnected between the timer and frequency inverter are variable resistors 45*a* and 45*b*. The variable resistors provide a control link between the timer and frequency inverter. When the timer is not engaged, current passes through variable resistor 45*a* and it directs the frequency inverter to supply power to the variable speed drive motor 38 that corresponds to the normal speed of travel of the traveling cleaner unit. When the timer 43 is engaged, current passes through variable resistor 45*b* and it directs the frequency inverter to supply power to the variable speed drive motor 38 or 38' of a magnitude that corresponds to the altered speed of travel of the traveling cleaner unit. The switching function of the timer determines which variable resistor current passes through and as such, determines the speed of travel of the traveling cleaner unit.

The interconnection between the timer 43 and frequency inverter 44 also contains overload protection 47, forward/reverse switch 48 and on/off switch 46 as is conventional. Overload protection 47 ensures that the current drawn by the variable speed motor 38 or 38' does not reach a magnitude that would harm the motor. The forward/reverse switch 48 reverses the rotation of the variable speed drive motor when the traveling cleaner unit or crane bridge reaches the termination of the overhead track 10 or rails 62, respectively, and thereby starts the traveling cleaner unit's movement in the opposite direction. The use of such forward/reverse switch 48 is known in the prior art and will not be further explained herein. Furthermore, an on/off switch 46 provides a means by which the power delivered to the variable speed drive motor can be manually disconnected to stop and start the movement of the traveling cleaner unit.

In the drawings and specification, there has been set forth preferred embodiments of the invention, although specific terms are employed, they are used in a generic and descriptive sense only and not for purpose of unduly limiting the scope of the present invention, which scope is defined by the appended claims.

That which I claim is:

1. A traveling cleaner system for cleaning textile machinery arranged in rows in a textile mill comprising:

a traveling cleaner unit including means for directing a cleaning current of air onto the textile machinery, means mounting said traveling cleaner unit above the textile machinery for movement along a predetermined path of travel along the rows of textile machinery so as to direct the cleaning current of air onto the underlying textile machinery, and means responsive to the traveling cleaner unit passing preselected areas of the textile mill for temporarily altering the rate of travel of the traveling cleaner unit so as to achieve more efficient cleaning of certain areas of the textile mill.

2. A traveling cleaner system according to claim 1 wherein said means for directing a cleaning current onto the machinery includes a plurality of movable nozzles extending downwardly from said traveling cleaner unit toward the underlying textile machinery, and means for reciprocating the nozzles transversely of the rows of textile machinery during movement of the traveling cleaner unit along the rows so as to thereby produce an oscillating sweeping pattern of said cleaning air currents for cleaning the textile machinery, and whereby the altering of the rate of travel of the traveling cleaner unit results in altering the density of the oscillating sweeping pattern of the cleaning air currents.

3. A traveling cleaner system according to claim 2 wherein said means for temporarily altering the rate of travel of the traveling cleaner unit comprises means responsive to the traveling cleaner unit passing preselected areas of the textile mill for temporarily reducing the rate of travel of the traveling cleaner unit so as to increase the density of the oscillating pattern of the cleaning currents and, thereby achieving a more concentrated cleaning of the preselected areas.

4. A traveling cleaner system according to claim 1 wherein said means for mounting said traveling cleaner unit comprises an overhead track mounted above the textile machinery and including drive means carried by the traveling cleaner unit for propelling the cleaner unit along the track at a predetermined rate of travel.

5. A traveling cleaner system according to claim 1 wherein said means for supporting said traveling cleaner unit comprises at least one overhead rail extending substantially parallel to underlying rows of textile machinery, a crane bridge extending transversely over said rows of textile machinery and supported by said rail with said traveling cleaner unit being mounted to said crane bridge, and drive means carried by said crane bridge for propelling the crane bridge along the overhead rail at a predetermined rate of travel.

6. A traveling cleaner system according to claim 1 wherein said means for temporarily altering the rate of travel of the traveling cleaner unit comprises means responsive to the traveling cleaner unit passing preselected areas of the textile mill for temporarily accelerating the rate of travel of the traveling cleaner unit so as to achieve less concentrated cleaning of those areas.

7. A traveling cleaner system for cleaning textile machinery arranged in rows in a textile mill comprising:

an overhead track mounted above the textile machinery, a traveling cleaner unit movable along the track, said traveling cleaner unit comprising a housing, means carried by said housing for directing a cleaning current of air onto the underlying machinery, drive means carried by said traveling cleaner unit for propelling the cleaner unit along the track at a predetermined rate of travel, said drive means including a variable speed motor for changing the rate of travel of the traveling cleaner unit, and means for temporarily altering the rate of travel of said traveling cleaner unit at preselected areas of the textile mill, and comprising:

an actuator mounted adjacent the path of travel of said traveling cleaner at the beginning of the preselected area of the textile mill where the rate of travel of the cleaner unit is to be altered, a sensor carried by said traveling cleaner unit and positioned for engagement by said actuator, and control means operatively connected to said variable speed drive motor and responsive to engagement of said sensor by said actuator for temporarily altering the speed of said variable speed drive motor.

8. A traveling cleaner system for cleaning textile machinery arranged in generally parallel rows in a textile mill comprising:

at least one overhead rail extending substantially parallel to the underlying rows of textile machinery, a crane bridge extending transversely of said rows, and supported above said rows by said at least one rail, drive means cooperating with said crane bridge for propelling said crane bridge along the overhead rail at a predetermined rate of travel, said drive means including a variable speed drive motor for changing the rate of travel of the crane bridge, at least one traveling cleaner unit mounted to said crane bridge and positioned above a row of textile machinery so that when the crane bridge travels along the overhead rail, the traveling cleaner unit passes over textile machinery in the underlying row; said traveling cleaner unit comprising a housing and means carried by said housing for directing a cleaning current of air onto the underlying machinery, and means for temporarily altering the rate of travel of said crane bridge at preselected areas of the textile mill, comprising:

an actuator mounted adjacent the path of travel of said traveling cleaner at the beginning of the preselected area of the textile mill where the rate of travel of the cleaner unit is to be altered, a sensor carried by said crane bridge and positioned for engagement by said actuator, and control means operatively connected to said variable speed drive motor and responsive to engagement of said sensor by said actuator for temporarily altering the speed of said variable speed drive motor.

9. A traveling cleaner system according to claim 7 or 8 where said control means additionally includes a timer for operating the variable speed drive motor at an altered rate of speed for a predetermined period of time.

10. A traveling cleaner system according to claim 7 or 8 wherein said control means includes:

a speed varying means interconnected with said variable speed drive motor and operable for altering the speed of said variable speed drive motor, and a timer interconnected to and activated by said sensor for engaging said speed varying means for a predetermined period of time.

11. A traveling cleaner system according to claim 10 wherein said speed varying means consists of voltage varying means.

12. A traveling cleaner system according to claim 7 wherein said traveling cleaner unit travels reciprocably on the overhead track and wherein said actuator includes means for engaging said sensor when the traveling cleaner unit travels in one direction, but not when it travels in the opposite direction.

13. A traveling cleaner system according to claim 8 wherein said crane bridge travels reciprocably on the overhead rail and wherein said actuator includes means for engaging said sensor when the crane bridge travels in one direction, but not when it travels in the opposite direction.

14. A traveling cleaner system for cleaning textile machinery in a textile mill comprising:

an overhead track mounted above rows of textile machinery, a traveling cleaner unit movable along the track, said traveling cleaner unit comprising a housing, reciprocating nozzles extending from said housing for directing an oscillating cleaning current of air onto the underlying machinery for removing lint from the textile machinery, suction means carried by said housing for collecting the lint removed from the textile machinery, drive means carried by said housing for propelling the cleaner unit along the track at a predetermined rate of travel, said drive means including a variable speed drive motor for changing the rate of travel of the traveling cleaner unit, and means for temporarily altering the rate of travel of said traveling cleaner unit comprising:

an actuator mounted adjacent the path of travel of the traveling cleaner unit at the beginning of a preselected area of the textile mill where the rate of travel of the cleaner unit is to be altered, a switch carried by said traveling cleaner unit and positioned for engagement by said actuator as the traveling cleaner unit moves past the actuator, a frequency inverter interconnected with said variable speed drive motor and actuated upon engagement of said switch for altering the speed of said variable speed drive motor so as to effect a change in the rate of travel of the traveling cleaner unit, and a timer interconnected to and activated by said switch for engaging said frequency inverter for a predetermined length of time.

15. A traveling cleaner system for cleaning textile machinery arranged in generally parallel rows in a textile mill comprising:

a pair of overhead rails extending substantially parallel to underlying rows of textile machinery, a crane bridge extending transversely of said rows, and supported above said rows by said rails, drive means for propelling the crane bridge along the overhead rails at a predetermined rate of travel, a plurality of traveling cleaner units mounted to said crane bridge and positioned above respective rows of textile machinery so that when the crane bridge moves along the overhead rail, the traveling cleaner units pass above the underlying rows of textile machinery; said traveling cleaner unit comprising a housing, reciprocating nozzles extending from said housing for directing an oscillating cleaning current of air onto the underlying machinery for removing lint from the textile machinery, and suction means carried by said housing for collecting the lint removed from the textile machinery, and means for temporarily altering the rate of travel of said traveling cleaner unit comprising:

an actuator mounted adjacent the path of travel of said traveling cleaner unit at the beginning of a preselected area of the textile mill where the rate of travel of the cleaner unit is to be altered, a switch carried by said crane bridge and positioned for engagement by said actuator as the crane bridge moves past the actuator, a frequency inverter interconnected with said variable speed drive motor and actuated upon engagement of said switch for altering the speed of said variable speed drive motor so as to effect a change in the rate of travel of the traveling cleaner unit, and a timer interconnected to and activated by said switch for engaging said frequency inverter for a predetermined length of time.

* * * * *